United States Patent [19]

Cox

[11] 4,419,065

[45] Dec. 6, 1983

[54] METHOD AND APPARATUS FOR SHAPING THE EDGES OF GREEN BRICK AND SEPARATING THE SAME

[75] Inventor: Joseph A. Cox, Fletcher, N.C.

[73] Assignee: EA Industries, Incorporated, Asheville, N.C.

[21] Appl. No.: 178,537

[22] Filed: Aug. 15, 1980

[51] Int. Cl.[3] ..... B28B 11/08

[52] U.S. Cl. ..... 425/301; 264/157; 425/302.1; 425/304; 425/305.1; 425/306; 425/307

[58] Field of Search ..... 425/301, 306, 307, 302.1, 425/305.1, 297, 304

[56] References Cited

U.S. PATENT DOCUMENTS

| | | | |
|---|---|---|---|
| 1,878,780 | 9/1932 | Keeler et al. | 425/305.1 |
| 3,468,998 | 9/1969 | Lingl | 425/307 |
| 3,478,397 | 11/1969 | Pearne et al. | 425/307 |
| 3,529,331 | 9/1970 | Putin | 425/307 |
| 4,147,491 | 3/1979 | Pastell | 425/304 |

*Primary Examiner*—James H. Derrington
*Attorney, Agent, or Firm*—William E. Mouzavires

[57] ABSTRACT

Green brick newly formed by pushing a slug through a wire cutter, have their longitudinal edges shaped by means of a plurality of rollers positioned above and across the path of conveyance of the bricks so that each roller simultaneously engages the adjacent edges of two adjacent bricks. The shape imparted to the brick edges is governed by the shape of the peripheral portions of the rollers. The rollers are mounted on a shaft at fixed locations along the shaft in alignment with the wires of the wire cutter. Before operation the locations of the rollers along the shaft may be adjusted through spacers in order to adapt the rollers to different sizes of bricks. The roller mounting shaft may be adjusted in a vertical plane towards or away from the conveyor path to adjust the depth of the rollers for a specific operation or to sufficiently raise the rollers away from the conveyor path where they may be kept idle when not in use. The shaping of the edges of the bricks causes brick material to adhere between adjacent bricks immediately below the edges which have been shaped. Accordingly, a plurality of cutter members are provided across the path of conveyance to enter between the rows of bricks to sever the adhering material between the bricks. The cutter members are mounted on individual arms which, in turn, are mounted on a cross member overlying said path such that the arms are movable transversely of the path. The cross member is adjustable in a vertical plane towards and away from the conveyor path to adjust the depth of the cutting member for a specific operation or to merely place them in an idle position when not in use.

17 Claims, 10 Drawing Figures

METHOD AND APPARATUS FOR SHAPING THE EDGES OF GREEN BRICK AND SEPARATING THE SAME

BACKGROUND OF INVENTION

In the art of making bricks, at times it is desirable to roll or otherwise shape the longitudinal edges of the brick to simulate old bricks or for other esthetic reasons. In the past when reel cutters were used to sever bricks from a slug, when it was desired to roll or otherwise shape the edges of the bricks, a technique termed in industry "paper cutting" was utilized. In this technique, paper was placed over the top surface or face of the slug so that when the rotating wire of the reel cutter descended upon and through the slug, the pressure on the paper as the wires severed through the paper and then through the brick resulted in the desired rolled edges along the top surface of the bricks.

In recent years, stationary or "push-through" wire cutters for forming bricks in many instances, have replaced reel cutters. Stationary wire cutters employ a plurality of generally vertical fixed wires spaced across a conveyor path so that when the slug is pushed through the wires, a plurality of bricks are formed on the "downstream" side of the wires. With the use of such stationary wire cutters, the problem arose that the paper cutting technique could not be employed due to the fact that the cutting wires are vertical and stationary and do not descend upon the slug in the manner of a reel cutter.

During recent years several attempts have been made to shape or otherwise roll the edges of green bricks formed through a stationary wire cutter. These methods usually have involved forming rollers or other members placed above the bricks to engage the edges of the bricks to shape them to the desired condition. While these methods may impart the desired rolled edge or other shape to the bricks, they create a most serious problem later during the processing of the bricks when it becomes necessary to space the rows of bricks for setting them on a kiln car or otherwise. For example, when "side grip" setters are used which grip the opposite sides of the brick, the rows of bricks are first spread apart by a spread table thus allowing the gripping members to descend between the bricks to engage the opposite sides of the bricks to pick them up and set them on a kiln car where they are taken to a kiln for firing and drying. Spread tables are disclosed, for example, in patents to Pearne, U.S. Pat. No. 3,478,397 and Jones, U.S. Pat. No. 4,119,217. The aforementioned problem was that when such spread tables were moved apart to space the rows of bricks, it was found that the bricks in adjacent rows adhered to each other and this was caused by brick material which was deformed and moved downwardly between the rows of bricks by the shaping rollers utilized to shape the edges of the bricks. Adherence of the rows of bricks to each other would naturally frustrate further processing of the bricks.

One attempt to solve the above problem is disclosed in the patent to Postell, Jr., U.S. Pat. No. 4,147,491, issued Apr. 3, 1979. According to the method disclosed in this patent, after the bricks are formed by pushing through a stationary wire cutter, alternate rows of bricks are elevated by ramps to place adjacent rows of bricks at different levels thus exposing the upper edges of alternate rows of bricks for engagement by rollers which shape the edges. This method utilizes a single roller for each row of bricks, that is, the roller has opposite end flanges which engage the opposite edges of the same brick in a single row; there being a plurality of such rollers for a plurality of rows of bricks. While such rollers may be used to impart a certain shape to the edges of the brick, they have been found to suffer from the drawback that they also create a bulge at upper sides of the brick at the edges stemming from the brick material which is displaced by the rollers.

The above method disclosed in the Postell, Jr. U.S. Pat. No. 4,147,491 also has been found to possess another, serious drawback, because it requires a vibrator 28 (see FIG. 4 and column 4, lines 44 to 50) for the purpose of returning the elevated bricks to the conveyor path. While the vibrators function to return the elevated bricks to the conveyor path, they also undesirably at times change the position or spacing between the rows of bricks to change the overall width of the entire group of bricks across the conveyor path. Subsequently, the groups of bricks may not be susceptible to machine-handling such as by a spread table or setter because of the change in dimension.

Another problem which has arisen with other types of shaping rollers apart from the aforementioned problem, was that the shaping rollers had to be adjusted periodically so that they would fit into the wire cutline between the rows of bricks because the cut line undergoes a slight deviation from a straight path.

SUMMARY OF OBJECTS

It is a primary object of the present invention to provide new and improved method and apparatus for shaping the edges of newly formed green brick whether the bricks are formed through a reel cutter or a fixed wire cutter or otherwise and which further will avoid the aforementioned problems heretofore encountered in connection with shaping the edges of bricks.

Another object of the present invention is to provide new improved apparatus for separating green brick after they have been rolled or shaped along their edges so that they may be subsequently spread apart such as on a spread table or otherwise spaced for firing and drying in a kiln. Included herein is such a method and apparatus which will separate newly formed green bricks which have been subjected to a slurry process on their top surfaces or faces for coloring the brick.

Another object of the present invention is to provide green brick with shaped or rolled edges to simulate old brick or other desired shapes and in a manner which may be mass produced commercially in conjunction with existing brick handling equipment.

SUMMARY OF INVENTION

In summary the present invention is achieved by providing a plurality of shaping members which may be termed "rollers" on a horizontal shaft spaced above and across the path of conveyance of newly formed green brick so that each roller has its periphery received between the adjacent rows of bricks along the cut line to simultaneously shape the edges of two adjacent bricks. While the rollers are, of course, rotatable about their mounting shaft, they are located at fixed positions along the shaft so that the distance between the rollers corresponds to the width or depth of the bricks. In instances where a fixed wire cutter is employed, that distance will correspond to the distance between the vertical wires of the wire cutter or stating it differently, the peripheries of the rollers will be in respective alignment with the vertical wires of the fixed wire cutter measured along the path of conveyance of the bricks.

In order to impart the desired shape to the edges of the bricks, the peripheral surfaces including the edges of the rollers are shaped with various surfaces and projections which will imprint a corresponding shape along the edges of the bricks. Moreover, the peripheral edges of the rollers are provided with a plurality of spaced projections which are made of a predetermined width so as to compensate for any deviation in the cut line between the bricks which, in actual practice, may contain a slight wavy shape. In this manner, a "wavy" cut line will not be reflected in the shape of the edges of the bricks due to the projections on the rollers which are sufficiently wide to remove or lessen trace of a wavy line along the edges of the bricks.

In shaping the edges of the bricks, each roller protrudes between the upper edges of adjacent bricks and the brick material which is displaced or deformed by the rollers is forced downwardly between adjacent bricks which causes the adjacent rows of bricks to become adhered to each other at upper portions thereof immediately below the path of the rollers.

In order to separate the adhering rows of bricks caused by the shaping rollers, a plurality of cutting members are positioned above and across the path of conveyance of the bricks to be receivable between the rows of bricks along the cut line to sever the brick material which adheres adjacent rows of bricks to each other. The cutting members are preferably formed by pin or needle members but they may also be formed from planar material such as, for example, pieces of steel formed from steel strapping material. Additionally, it is important that the cutting members be self-adjustable in a direction transversely of the path of conveyance of the bricks to conform to a wavy cut line.

In the preferred embodiment of the invention, each of the cutting members is mounted to an individual arm which, in turn, is mounted on a cross member extending above and across the conveyor path so that there are a plurality of mounting arms with cutting members depending therefrom. In the preferred embodiment of the invention, the arms are pivotally mounted to the cross member to allow the cutting members to swing transversely of the conveyor path to accommodate the contour of the cut line.

The cross member mounting the arms may be raised or lowered relative to the conveyor path to adjust the vertical depth of the cut and also to place the cutter members in idle position away from the conveyor path in cases where cutting of the bricks is not required. Similarly, the mounting shaft of the shaping rollers is preferably mounted for adjustable movement in a vertical plane towards and away from the path of conveyance.

While the cutter members of the present invention are highly suitable for severing material adhering to adjacent rows of bricks after they have been shaped along their edges by the rollers, the cutting members of the present invention may also be utilized apart from any edge-shaping operation. For example, in situations where the bricks are colored and a slurry is applied to the top surface of the bricks causing the adjacent rows of bricks to adhere to each other, the present invention is admirably suited for cutting through the slurry material to separate the adjacent rows of bricks. Therefore, the cutting mechanism of the present invention need not be limited to shaping the edges of the bricks.

DRAWINGS

Other objects and advantages of the present invention will become apparent from the following more detailed description taken in conjunction with the drawings in which.

DETAILED DESCRIPTION

Figure 1:
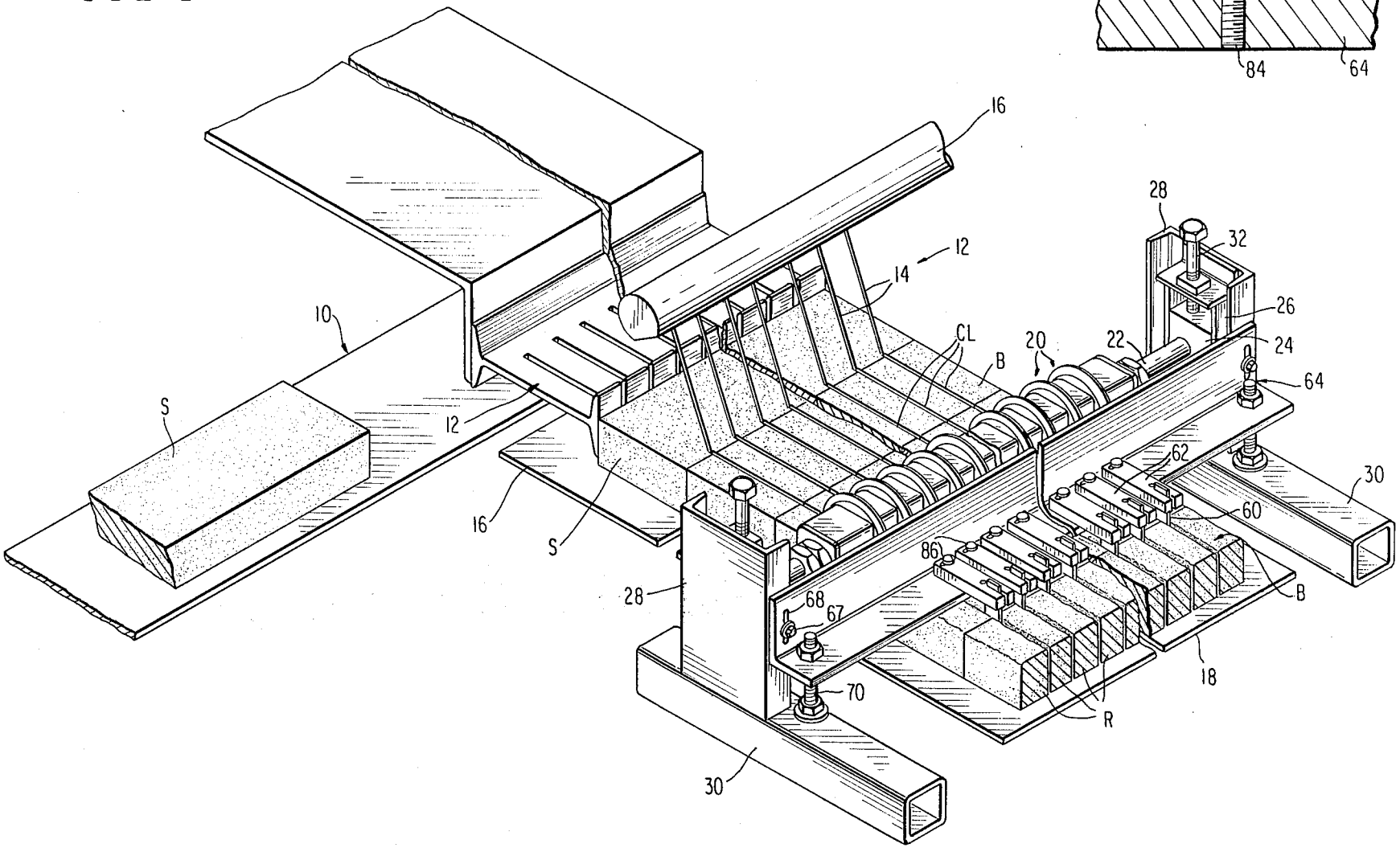
FIG. 1 is a perspective view of a portion of a brick forming and handling system incorporating apparatus constituting one embodiment of the present invention.

Referring now to the drawings in detail, there is shown in FIG. 1 for illustrative purposes only, apparatus for forming green bricks B in a plurality of rows R from slugs S; the apparatus incorporating the present invention. The shown apparatus includes a first horizontal "off-bearing" conveyor 10 for conveying slugs S to a cutting station where the slugs are pushed transversely from the conveyor 10 by a pusher 12 through a fixed wire cutter 12 which typically includes a plurality of generally vertically extending spaced and parallel wires 14 having their opposite ends fixed to mounting bars 16 and 17 (see FIG. 2) which extend above and below the path of conveyance of the bricks. As illustrated in FIG. 1, as the slug S is pushed through the cutting wires 14, the latter sever the slugs into rows of bricks. The lines of cutting or "cut lines" of the wires 14 are represented by CL and they, of course, constitute the spacing between the rows of bricks which are formed.

From the belt of off-bearing conveyor 10, the slugs S are pushed onto a receiving bed or platform 16 and then after the bricks B are cut from the slugs S, they are deposited on a subsequent slide bed 18 which may either be stationary or periodically movable as part of a horizontal conveyor bed. The apparatus described thus far is conventional and therefore, a further description thereof is not believed to be necessary.

In accordance with the present invention, a novel mechanism for shaping the edges of the newly formed green brick B is provided downstream of wire cutter 12 as best shown in FIG. 1. This mechanism includes a plurality of forming members which, in the preferred embodiment, are rollers 20 and which in industry are sometimes referred to as "texture rollers".

Figures 2, 5, 6, 7:
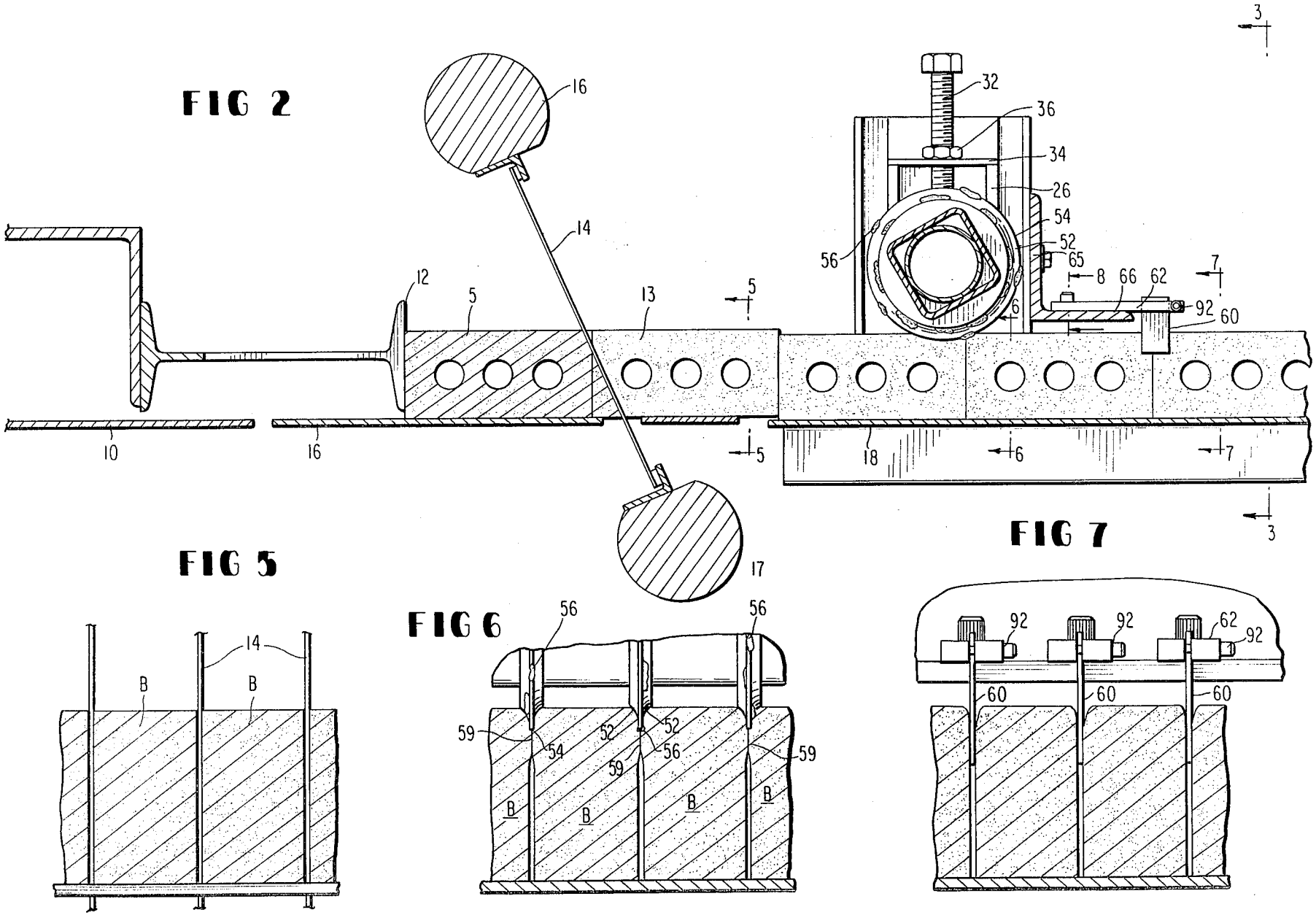
FIG. 2 is a side elevational view with parts in cross section, of the apparatus of FIG. 1.
FIG. 5 is a cross-sectional view taken generally along lines 5—5 of FIG. 2.
FIG. 6 is a cross-sectional view taken generally along lines 6—6 of FIG. 2.
FIG. 7 is a cross-sectional view taken generally along lines 7—7 of FIG. 2.

Rollers 20 are mounted for rotation about and relative to a shaft 22 which extends above and across the path of conveyance of the bricks as best illustrated in FIG. 1. The opposite ends of roller mounting shaft 22 are suitably journaled in bearing boxes 24 which are mounted for vertical adjustable movement in guide ways 26 fixed in vertical frame 28 which are anchored on horizontal frame structure 30. Bearing boxes 24 are provided with adjusting bolts 32 which extend through a fixed mounting wall 34 at the top of guide ways 26 with the lower ends of the bolts threadedly received in bearing boxes 24 as shown in FIGS. 1 and 2. Bolts are fixed against vertical movement by nuts 36 engaged against walls 34 such that, upon rotation of the bolts, the bearing boxes 24 will rise upwardly or downwardly in the guide ways 26 along the bolts relative to the frame for adjusting the position of the shaft 22 and, in turn, the texture rollers 20 for reasons to become clear below.

Figure 3:
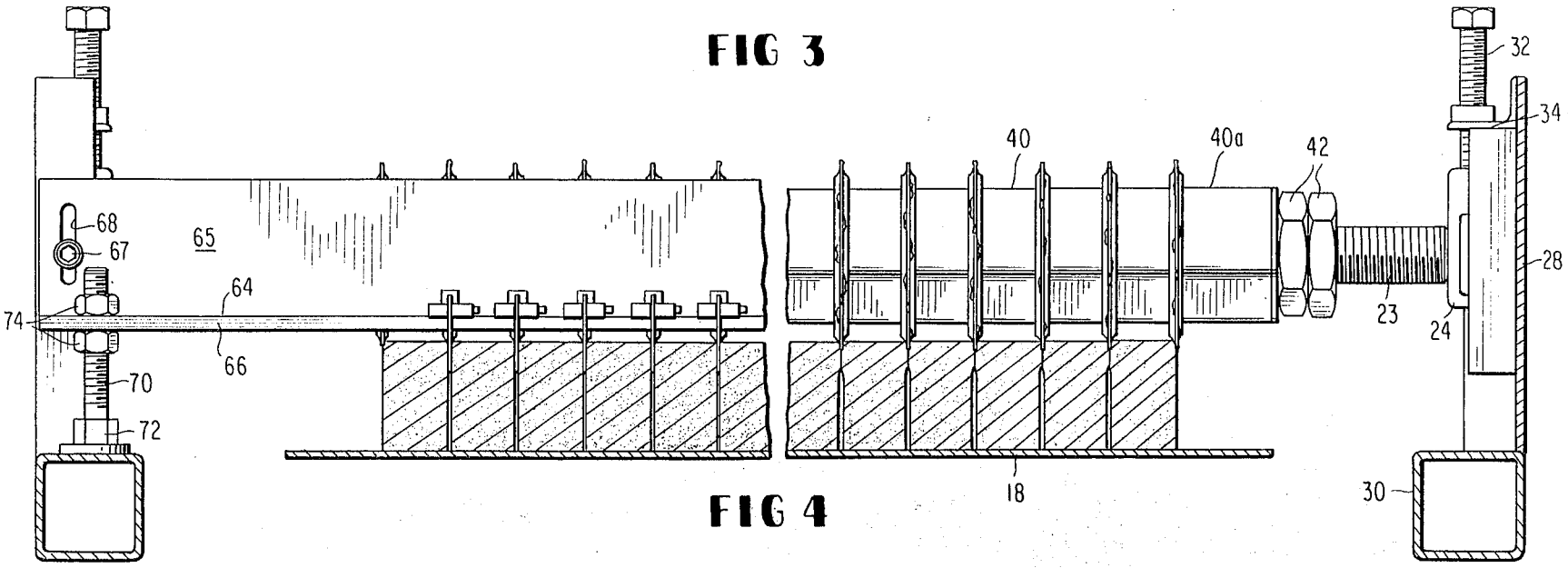
FIG. 3 is a cross-sectional view taken generally along lines 3—3 of FIG. 2.

Texture rollers 20 are mounted for rotation at fixed positions along the shaft by means of suitable spacers generally designated 40, such that the peripheral edges of the rollers are aligned with the cutting wires 14 at the fixed wire cutter 12 and so that the distance between the rollers corresponds to the depth of the bricks to be formed. Of course, different sized spacers 40 may be employed for different sizes of bricks. Once rollers 20 are adjusted in a desired position, they are fixed against movement longitudinally of the shaft by means of the lock nuts 42 provided at the opposite ends of the shaft 22 about threads 23 formed on the opposite ends of the shaft with the innermost lock nut engaged against the outermost spacer 40*a* as best shown in FIGS. 1 and 3.

Referring now to FIGS. 2 and 6, the texture rollers 20 themselves in the preferred embodiment have a generally disc-like configuration with the peripheral surfaces 52 on the opposite sides thereof extending radially outwardly in converging fashion along concave arcs which meet at a thin peripheral circular edge 54. The concave surfaces 52 will impart rolled edges to the bricks as will be further described below. Additionally, the peripheral edges 54 of each roller are provided with a series of angularly spaced projections 50 which may be formed by weld beads so as to shape the edge portions of the bricks accordingly. In addition, the opposite peripheral concave surfaces 52 of the rollers are provided with angularly spaced projections in the form of weld beads 58 to impart a desired impression or shape to the edges of the bricks to make them appear as old bricks or for other esthetic reasons.

In operation, the newly formed green bricks conveyed along slider bed 18 sequentially through the action of the pusher 12 will arrive below the texture rollers 20 with the lines of cut CL below the peripheral edges 54 of the texture rollers which as indicated above have adjusted into fixed locations along the shaft for this reason. As the newly formed green brick are pushed below the rollers by the succeeding bricks, the peripheral edge and surface portions of each roller will engage the top edges of two adjacent bricks as shown in FIG. 6 to roll the edges and otherwise imprint the desired shape thereto. It should be noted that the width of the projections 56 on the peripheral edges 54 of the rollers is designed so that should there be any deviation in the cut line CL that would otherwise impart a slightly wavy edge to the bricks, the projections 56 will be effective to remove such wavy shape and instead, provide rolled edges which extend substantially along a straight line.

The depth of the rolled edges of the bricks imparted by the rollers is governed by the dimensioning of the peripheral surfaces of the rollers and by the vertical height of the rollers which may be adjusted through means of adjusting bolts 32 described above. Should it be desired to form bricks without rolled edges, the rollers 20 may be raised sufficiently away from the bricks to an inactive position again by means of the adjusting bolts 32.

As should be apparent the above, each roller (with the exception of the end-most rollers) engages adjacent edges of adjacent bricks as best shown in FIG. 6. Furthermore, the brick material which is removed from the edges by the rollers is pushed or deformed downwardly into the spaces between the bricks to cause the bricks to adhere at points 59 shown in FIG. 6. This adherence of the bricks is objectionable because subsequently when the rows of bricks are to be spread apart such as when on a spread table, to accommodate gripping fingers of setters which grip the opposite sides of the bricks, the bricks will not seperate and further brick handling will be frustrated.

Therefore, in order to separate the adhering bricks from each other resulting from the shaping of the edges by the texture rollers, a novel cutter mechanism is utilized downstream of the texture rollers along the path of conveyance of the bricks in accordance with the present invention. The cutter mechanism includes a plurality of indivudal cutting members which in the specific embodiment shown in FIGS. 1 to 8, are formed by planar steel members 60, for example, one and one-quarter of an inch ($1\frac{1}{4}''$) in width which may be fabricated from material such as steel strapping. However, in the preferred embodiment shown in FIGS. 9 and 10, the cutting members are formed from needles as will be described further below. Cutting members 60 are positioned in spaced parallel planes across the path of conveyance of the bricks so as to be received within the cut lines CL between the rows of bricks to sever the brick material which adheres the bricks at areas 59 (see FIG. 6). The depth of the cutting members is chosen accordingly to accomplish the aforegoing result.

Due to the fact that in actual practice the cut lines CL at times deviate in a slightly wavy pattern, it is important that the cutting members be able to adjust to the deviations in the cut line for otherwise, the cutting members will cut elongated slivers from the bricks rather than merely separating or severing the material which adheres the bricks.

In the preferred embodiment cutting members 60 are mounted to achieve the foregoing results by means of a plurality of individual mounting arms 62 spaced across and above the path of conveyance of the bricks where they are mounted to a cross-piece 64 in the form of an angle bar having a horizontal leg 66 and vertical leg 65 bolted at 67 to the vertical support frame structures 28 on opposite sides of the path of conveyance of the bricks. Bolts 67 are received in elongated slots 68 of the vertical legs 65 so that the cross-piece 64 may be adjusted into the desired vertical position to either place the cutting members at the desired depth relative to the bricks or to entirely remove the cutting members sufficiently upwardly away from the bricks in cases where the cutting members are not to be utilized. The actual adjustment of the cross-piece 64 is achieved by adjusting bolts 70 (FIG. 3) received through the horizontal leg 66 of the cross-piece on opposite ends thereof and through a female threaded receptacle such as nuts 72 fixed to the horizontal frame members 30 on opposite sides thereof. By loosening lock nuts 74 on bolts 70 on opposite sides of leg 66 of the cross-piece, the elevation of the cross-piece and in turn the cutting members 60 may be adjusted. Once the desired adjustment is effected, lock nuts 74 are tightened against the leg 64 to lock the cutters in the desired position.

Figure 8:
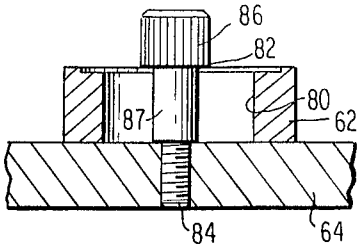
FIG. 8 is a cross-sectional view taken generally along lines 8—8 of FIG. 2.
Figure 4:
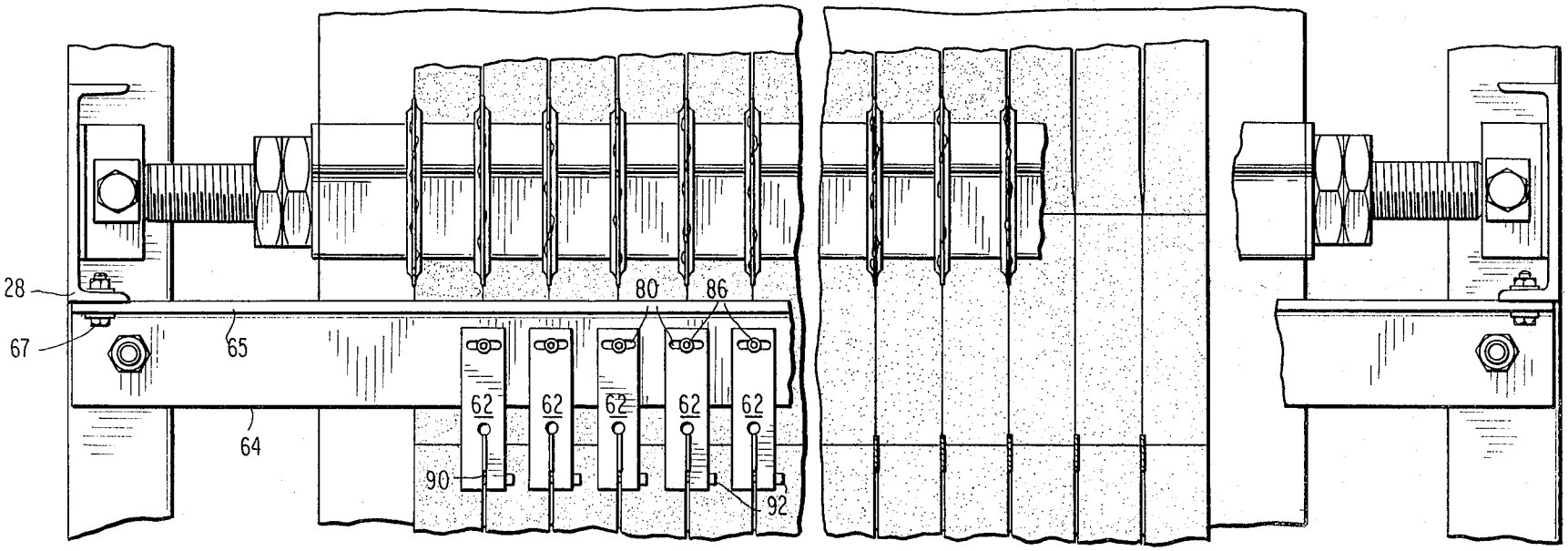
FIG. 4 is a plan view of the apparatus with portions broken away.

Referring now to FIGS. 1, 4 and 8, the mounting arms 62 for the cutting members 60 are mounted to the cross-piece 64 by means of elongated slots 80 formed through the end portions of the mounting arms 62 to receive vertical mounting pins 82 which extend through slots 80. Pins 82 have threaded ends of reduced diameter and threaded into the horizontal leg 66 of the cross-piece to fix the same relative thereto. As shown in FIG. 8, mounting pins 82 are provided with enlarged head portions 86 which span the slots 80 to fix the mounting arms 62 against any vertical movement relative to the cross-piece 64. In operation, when the mounting arms 62 are subjected to lateral forces resulting from deviations in the path of the cut lines CL of the bricks, the mounting arms will move relative to their pins 82 to accommodate the contours of the cut line. In this way, it will be assured that the cutting members 60 will not cut elongated slivers along the edges of the bricks but rather, will only cut the material which adheres the adjacent bricks together for reasons noted above.

In the specific embodiment shown, the free end portions of the mounting arms 62 are bifurcated to provide elongated slots 90 which receive the cutting members 60 as best shown in FIGS. 1, 4 and 7. The uppermost portions of the cutting members 60 project above the mounting arms 62 and the bifurcated free end portions of the mounting arms are clamped together by means of clamp bolts 92 which are received in threaded passages formed in the free end portions of the mounting arms as best shown in FIGS. 4 and 7. Tightening of clamp bolts 92 will result in clamping the cutting members 60 firmly between the bifurcated end portions of mounting arms 62.

In operation, after the bricks have been rolled or shaped along their edges by the texture rollers, they will proceed to the cutting members 60 which will be received in the cut lines CL to sever the adhering material at 59 (FIG. 6) to thus reestablish the necessary spaced relationship between the adjacent rows of bricks. Should it be desired to process bricks without the cutter mechanism, the adjusting bolts 70 may be adjusted to raise the cross-piece 64 away from the path of conveyance of the bricks to allow the bricks to pass without any contact with the cutter members 60.

Figure 9:
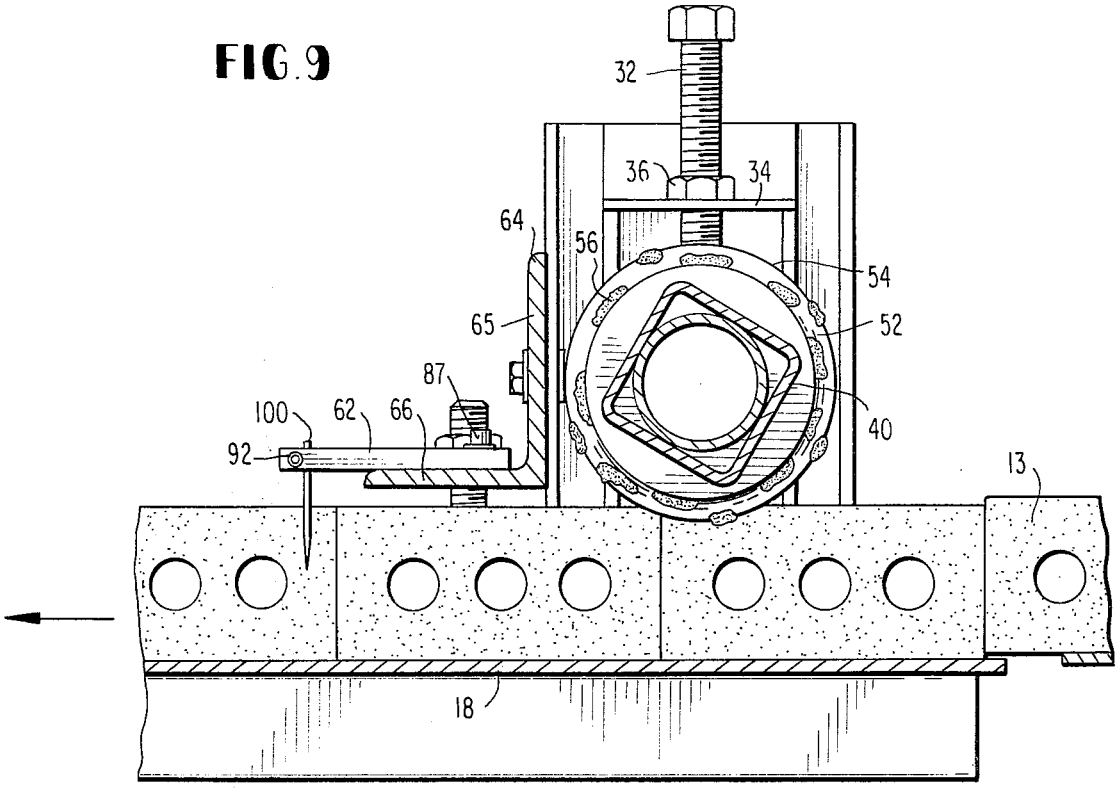
FIG. 9 is a side elevational view with parts in cross section of apparatus incorporating preferred features of the present invention.
Figure 10:
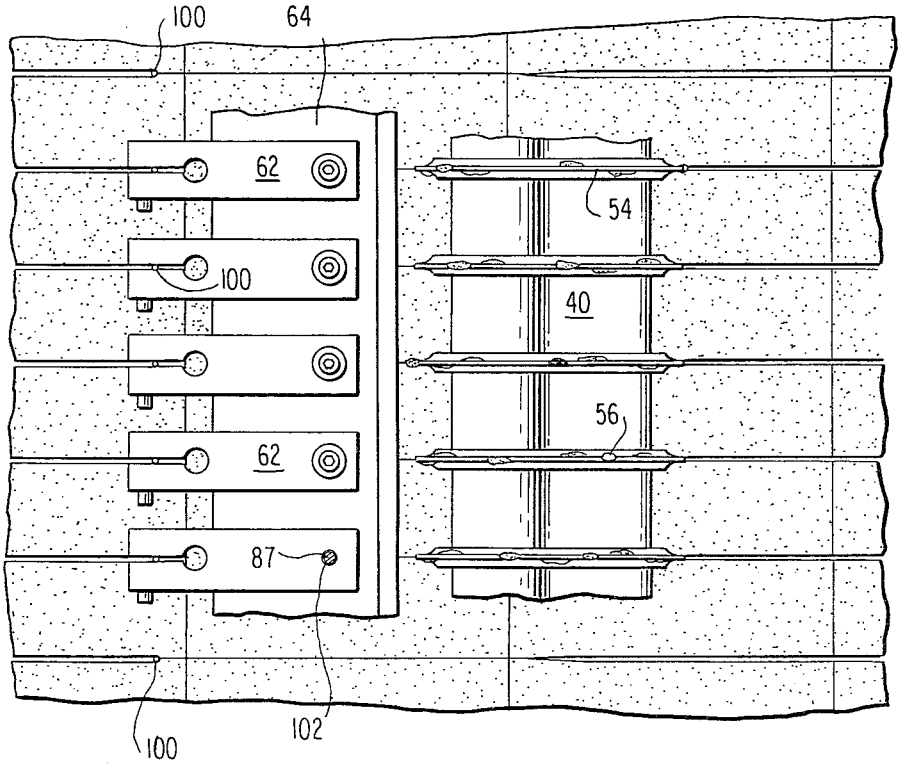
FIG. 10 is a plan view of the apparatus shown in FIG. 9.

With the exception of the planar cutting members 60 and the slots 80 for receiving the mounting pins 87, the apparatus described above constitutes the preferred embodiment of the invention. Rather than the planar cutting members 60, it is preferred that needle or pin members 100 be employed for severing the adhering brick material between adjacent rows of bricks. Referring now to FIGS. 9 and 10, such preferred, cutting members 100 are shown. additionally, circular apertures 102 in the cutting member mounting arms 62 are employed in place of the elongated slots 80 to mount the arms 62 to the cross-piece 64. In this way, the arms 62 and needles 100 are free to only pivot relative to the cross-piece 64 about pins 87 in adjusting to the contour of the cut line CL.

While the cutter mechanism shown and described is uniquely suited for severing the adhering material between the rows of bricks resulting from rolling the edges of the bricks, the cutter mechanism of the present invention may also be employed apart from association with any edge-rolling operation. For example, when newly formed bricks are colored, a slurry is deposited on the top surface of the slugs or bricks having the desired coloring pigment. This slurry enters the spaces along the cut lines between the rows of bricks and results in adhering the rows of bricks to each other. The cutter mechanism of the present invention may be advantageously employed to cut through the adhering portions of the slurry to ensure that the rows of bricks may later be separated from each other.

It will be seen from the above that the present invention may be employed not only to provide the desired texture or shape along the edges of the bricks but also, it does not effect the overall width of the entire group of bricks being conveyed to ensure that subsequent brick handling machinery will be adaptable to the group of bricks. In addition, the present invention provides the desired edge without any unnecessary bulges formed such as results from certain method and apparatus of the prior art. Furthermore, the apparatus for carrying out the method of the invention is relatively simple and maintenance-free while avoiding the requirement for readjusting the positions of the cutting rollers during an operation to conform to wavy cut lines. Moreover, the methods and apparatus of the present invention may be easily incorporated into brick forming and handling systems currently utilized in industry.

What is claimed is:

1. In combination with apparatus for cutting slugs into rows of green bricks including a wire cutter having a plurality of horizontally spaced fixed generally vertical wires extending across a path of conveyance in side-by-side relationship, means for shaping the edges of the bricks after leaving the wire cutter including a plurality of rollers mounted for rotation about a horizontal axis extending across the path of conveyance, the rollers being position along said axis at fixed locations aligned with said wires, respectively, such that peripheral portions of each roller will simultaneously engage the adjacent edges of adjacent bricks to shape the same, and wherein said rollers have means on their peripheral portions for shaping the edges of the bricks, and wherein the apparatus further includes cutting means positioned along the path of conveyance downstream of the rollers for cutting portions of the bricks located between adjacent rows of bricks for separating the rows of bricks from each other.

2. The apparatus defined in claim 1 wherein opposite sides of each roller adjacent the periphery thereof have concave surface portions merging into the peripheral edge of the roller for imparting rolled edge portions to bricks.

3. The apparatus defined in claim 2 wherein a number of the rollers each have a first set of projections at spaced locations about their peripheral edges and additional projections on opposite sides thereof adjacent the peripheral edges for shaping the edges of the bricks.

4. The apparatus defined in claim 1 wherein said cutting means includes a plurality of individual cutting members spaced across the path of conveyance for receipt between adjacent rows of bricks to sever material adhering between adjacent rows of bricks as a result of the shaping of the edges by the rollers.

5. Apparatus for shaping and handling newly formed green brick during conveyance in rows along a path, the apparatus comprising in combination; a plurality of forming members positioned above and across said path to be engageable with and between adjacent bricks of adjacent rows to shape the upper edges of the bricks with each forming member simultaneously shaping the adjacent edges of adjacent rows of bricks, and means downstream of the forming members for entering between adjacent rows of bricks for severing material adhering to adjacent bricks resulting from the shaping of the edges thereof, and wherein said forming members are rollers mounted for rotation about a common horizontal axis extending across said path.

6. The apparatus as defined in claim 4 wherein said cutting means further includes mounting means mounting the cutting members in spaced position across said path for receipt between the rows of bricks, said mounting means permitting said cutting members to move in a direction transversely of the path of conveyance to accommodate any deviations in the cut line.

7. Apparatus defined in claim 6 wherein said mounting means allows pivotal movement of the cutting members in a generally horizontal plane generally or parallel to the path of conveyance.

8. Apparatus defined in claim 6 wherein said cutting members are planar members whose planes extend generally vertically and parallel to each other and perpendicular to the horizontal path of conveyance of the bricks.

9. Apparatus defined in claim 7 wherein said cutting members are needle members extending generally vertically and parallel to each other and perpendicular to the horizontal path of conveyance of the bricks.

10. Apparatus defined in claim 6 wherein said mounting means includes a cross member extending above and across the path of conveyance, a plurality of arms mounted to the cross members, said cutting members being respectively mounted to the arms.

11. Apparatus defined in claim 10 wherein said mounting means includes means mounting the arms for movement in a direction transversely of the path of conveyance of the bricks to accommodate deviations in the cut lines.

12. Apparatus defined in claim 11 wherein said last defined means includes apertures in said arms and pins respectively extending through the apertures and into said cross member.

13. Apparatus defined in claim 12 wherein said apertures are dimensioned relative to the pins to permit pivotal movement of the arms about and relative to the pins.

14. Apparatus defined in claim 13 wherein said cutting members are needle members extending generally vertically and parallel to each other and perpendicular to the horizontal path of conveyance of the bricks.

15. Apparatus defined in claim 14 wherein said arms have slots extending therein with said needle cutting members being received in said last-defined slots respectively.

16. Apparatus defined in claim 15 wherein said arms are each bifurcated in one end to form said slots receiving said cutting members, and wherein there is further included means for clamping the cutting members between the bifurcated portions of the arms.

17. Apparatus defined in claim 6 wherein said mounting means is adjustable in a vertical plane to adjust the level of the cutting members.

* * * * *